US005324127A

United States Patent [19]

Cortez

[11] Patent Number: 5,324,127

[45] Date of Patent: Jun. 28, 1994

[54] APPLICATOR FOR DRESSING HEELS AND EDGES OF SHOE SOLES

[76] Inventor: Don R. Cortez, 700 E. Ocean Blvd. Unit 2303, Long Beach, Calif. 90802

[21] Appl. No.: 104,359

[22] Filed: Aug. 9, 1993

[51] Int. Cl.[5] ..... B05C 1/08; B05C 17/02; A47L 23/04

[52] U.S. Cl. ..... 401/119; 15/230.11; 401/126; 401/202; 401/208; 401/130

[58] Field of Search ..... 15/230.11, 104.002; 401/208, 202, 119, 126, 130

[56] References Cited

U.S. PATENT DOCUMENTS

| | | | |
|---|---|---|---|
| 2,008,942 | 7/1935 | Beall | 15/230.11 |
| 2,947,015 | 8/1960 | Burt | 401/202 X |
| 3,201,815 | 8/1965 | Selby | 15/230.1 X |
| 3,226,754 | 1/1966 | Brittain | 15/230.11 |
| 3,609,051 | 10/1969 | Braun | 401/197 |
| 4,361,923 | 12/1982 | McKay | 15/104.002 |
| 4,384,589 | 5/1983 | Morris | 401/202 X |
| 4,644,604 | 2/1987 | Kierce | 15/230.11 |
| 4,648,732 | 3/1987 | Smialkowski | 401/208 X |
| 5,146,646 | 9/1992 | Langford et al. | 15/210.1 |

FOREIGN PATENT DOCUMENTS

| | | | |
|---|---|---|---|
| 3208459 | 9/1983 | Fed. Rep. of Germany | 15/230.11 |

*Primary Examiner*—Steven A. Bratlie
*Attorney, Agent, or Firm*—Abelman Frayne & Schwab

[57] ABSTRACT

A shoe-polish applicator for dressing the edges and heels of shoe soles, which includes a roller saturated with a fluid dressing agent. The roller is comprised of Sif Felt® foam and is rotatably mounted on an inflexible shaft. The Sif Felt® foam roller is capable of absorbing and retaining and then transferring enough fluid dressing agent to eliminate the requirement of a shoe-polish reservoir.

1 Claim, 2 Drawing Sheets

APPLICATOR FOR DRESSING HEELS AND EDGES OF SHOE SOLES

FIELD OF THE INVENTION

The present invention relates to a shoe-polish applicator for dressing the heels and edges of shoe soles. The applicator is fast and easy to operate and can be conveniently stored in one's pocket or suitcase for travel.

BACKGROUND OF THE INVENTION

Shoe-polishing devices of themselves are well-known, each of which are designed to apply a cream, liquid or paste to shoe uppers via a roller or brush. Such shoe-polish is stored in some type of container which is usually the handle of the device. The shoe-polish is usually applied by soft brushes or rollers which are connected to the handle which stores the polish. These rollers and brushes are usually soft so that they can conform to the uppers of the shoes and apply the shoe-polish to the entire surface of the shoe. Many of the brushes and rollers rotate while applying the shoe-polish either by mechanical or manual methods.

The obvious drawbacks of these type of applicators is the threat of having the creams or the paste from a stick of shoe polish get onto a users hands or clothes when handling the stick of shoe-polish to place it in the container of the applicator which holds the stick. An example of a shoe-polish applicator which utilizes a stick of paste is U.S. Pat. No. 2,705,811 issued to Moran, which discloses a rotating brush applicator rotatably mounted on a hollow handle. A shoe-polish paste in the form of a stick must be placed in the hollow handle prior to use. An opening allows communication between the hollow handle and the axial rotating brush such that a spring urges the stick into contact with the brush.

Liquid reservoir type applicators create the possibility of the liquid polish leaking from the reservoir and staining items around the applicator. This is common when one is traveling and must carry the applicator in a suitcase amongst items such as expensive clothing which then is destroyed. An example of a shoe-polish applicator which utilizes a roller to dispense fluid from a reservoir is U.S. Pat. No. 4,648,732 issued to Smialkowski, which discloses a soft roller which is in communication with a liquid shoe-polish reservoir. The soft roller spreads the liquid shoe-polish over the shoe uppers.

Another disadvantage of most shoe-polish applicators is that they are designed to polish the shoe upper and do not have brushes or rollers of a size dimension which conform to the heel or edges of shoe soles. Further, soft brushes and rollers are not capable of absorbing the liquid shoe polish thereby creating a need for the liquid reservoir to hold surplus shoe-polish for replenishing the brush for the next use.

These conventional shoe-polish applicators are further very limited in their range of use. They must only be used on shoes with leather uppers.

Another type of shoe-polish applicator uses pads for dispensing creams, or even liquid, housed in a reservoir which is in communication with the pads. The drawback encountered when using these type of applicators is the common occurrence of the pad drying into a hardened mass after use. The cream or liquid enters into the cells of the pad during operation. After use the shoe dressing remains in the cells of the pad and hardens tending to cause the pad to similarly harden and become unusable after only a few applications of shoe-polish. An example of this type of shoe-polishing device is U.S. Pat. No. 3,147,512 issued to Gleason, which discloses a spongy member which surrounds a nipple. Shoe-polishing cream housed in a reservoir exits from the nipple during operation and is spread around the desired surface by the spongy member.

U.S. Pat. No. 3,609,051 issued to Braun, discloses an artists spin brush having a soft roller rotatably mounted to one end of a handle. Liquid paint and the like is housed in the handle of the spin brush. This patent does not relate to polishing of shoes.

It hitherto has been found to be impossible to provide a shoe-polish applicator which can apply polish to shoes and shoe soles but which does not require paste in the form of a stick or a liquid containing reservoir. It has also been found to be impossible to provide an applicator which is capable of absorbing enough liquid shoe-polish for numerous applications while not drying into hardened mass and still providing resilient qualities to permit clean, defined shoe polishing.

Accordingly, it is the primary object of the present invention to provide a shoe-polish applicator which does not require a reservoir to hold a supply of the shoe polish.

It is another object of the present invention to provide a light and compact shoe-polish applicator capable of being carried conveniently in one's pocket or suitcase when traveling.

It is yet another object of the present invention to provide an applicator which provides for fast, easy and convenient polishing of heels and edges of shoe soles.

It is also an object of the present invention to provide an applicator of liquid shoe polish which provides a clean, defined finish to heels and edges of shoe soles.

A further object of the present invention is to provide a shoe-polish applicator which is of substantially simple and inexpensive design and manufacture.

Still a further object of the present invention is to provide a method of polishing heels and edges of shoe soles.

These, as well as further objects and advantages of this invention, will become apparent to those skilled in the art when they review the accompanying detailed description of the preferred embodiments, reference being made to the accompanying drawings.

SUMMARY OF THE INVENTION

In accordance with the above-mentioned objectives and others, the applicator of the present invention comprises a roller saturated with a fluid dressing agent and comprising a material capable of absorbing and retaining the fluid such that when in operation the roller is contacted to a heel or edges of shoe soles a controlled amount of the fluid is transferred to the heel or edges. The applicator includes mounting means for rotatably mounting the roller to an inflexible handle.

In a preferred embodiment the handle of the present invention is hollow and cylindrical and includes grip means along the outside portion of the handle for facilitating holding of the applicator. The mounting means of the applicator is preferably comprised of a hollow shaft secured to an end of the handle and extending longitudinally from that end with the roller rotatably mounted on the shaft. In an even more preferred embodiment, the mounting means further comprises a bearing disposed between the roller and the shaft to allow the roller to rotate more freely about the shaft.

The applicator further comprises retaining means for retaining the roller on the shaft during use.

The roller of the applicator is preferably comprised of Sif Felt® foam and the fluid dressing agent can be inks, dyes, powders, stains or clear polishes.

In another preferred embodiment, a cap is removably secured to the handle to cover the roller. In an even more preferred embodiment, the cap includes a Sif Felt® wicking foam attached to the underside of the top of the cap for re-inking the roller when the applicator is not in use.

The present invention is also directed to a method for applying a fluid dressing agent to the heels and edges of shoe soles, comprising pre-saturating a roller comprised of Sif Felt® foam, contacting the roller with the heels and edges of the shoe soles, rollably moving the roller along the length of the heel and edges to apply the fluid to them, and covering the roller with a cap having a pre-saturated Sif Felt® wicking foam attached to the underside of the top of the cap for re-inking the roller after use.

BRIEF DESCRIPTION OF THE DRAWINGS

The following drawings are illustrative of preferred embodiments of the invention and are not meant to limit the scope of the invention as encompassed by the appended claims.

DETAILED DESCRIPTION OF THE PREFERRED EMBODIMENTS

Figure 1:
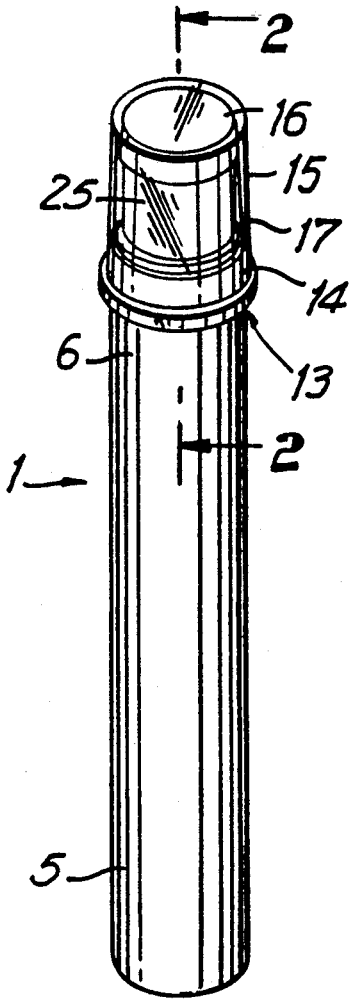
FIG. 1 is a front elevation of an embodiment of the applicator of the present invention.

Referring now to the drawings, FIG. 1 shows the shoe-polish applicator of the present invention generally indicated by the reference numeral 1. The handle 5 supports the shaft 35 (see FIG. 2) around which is disposed the roller 25. The roller 25 is enclosed in the cap 15. The cap 15 has a top 16, sidewall 17 and an opening 13 at its bottom end 14.

The handle 5 must be inflexible to allow the roller 25 to be pressed against the surface to be dressed with shoe-polish. The handle 5 can be comprised of any suitable material which is readily recognizable by those skilled in the art. Preferably, however, the handle 5 is hollow and cylindrical and comprised of polypropylene plastic, having a large bore 7, and a diameter of ¾ of an inch and a length of 4 and 3/16 of an inch.

The handle 5 may also comprise ribs or other protrusions around the outside surface of the top 6 of handle 5 to facilitate the grip on the handle. Rubber pads may also be placed on the outside of the handle 5 to make holding the handle 5 easier for a user. In an even more preferred embodiment the handle 5 is color coded to allow a user to recognize the type of shoe-polish contained in the roller 25 without removing the cap.

The cap 15 is preferably transparent. The cap 15 also is preferably comprised of plastic for ensuring that the applicator 1 remains lightweight. The cap 15 has an opening 13 on a bottom end 14 of sidewall 17. The cap 15 may be secured to the handle 5 by any suitable method. For example, the cap 15 may have threads on the inside of the bottom end 14 which mate to threads on the outside of the top 6 of handle 5 such that the cap 15 is screwed onto the handle 5.

The cap 15 may also be attached to the handle 5 through the use of a ridge on the inside of the bottom end 14 of sidewall 17 snap fitting over a similar ridge around the circumference of the top end 6 of handle 5. This is possible because the cap 15 is made of resilient materials.

The preferable method of attaching the cap 15 is by a friction fit between the cap 15 and the handle 5 where the opening 13 has a larger diameter than that of the handle 5 but as the cap 15 progresses toward a top 16 the diameter is slightly smaller than that of the handle 5 thereby ensuring a tight fit of the cap 15 over the handle 5.

Figure 2:
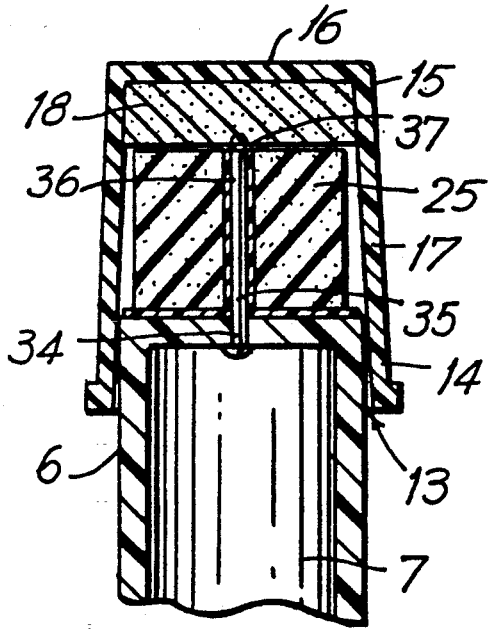
FIG. 2 is a cross-sectional view taken along line 2—2 of FIG. 1, showing the relationship between the shaft and the roller, and the relationship between a wicking foam of the cap and the roller.

In another preferred embodiment the cap 15, as shown in FIG. 2, has a wicking foam 18 saturated with a fluid dressing agent adhered to the underside of top 16 of cap 15. The wicking foam 18 may be comprised of any material which is capable of absorbing and retaining the fluid and then transferring it upon contact with another surface, however, the wicking foam 18 is preferably comprised of Sif Felt® foam. The wicking foam 18 is attached along the entire underside of the top 16 of cap 15 by any suitable adhesive. The wicking foam 18 transfers the fluid dressing agent to the roller 25 by capillary action. FIG. 2 further shows lock ring 37 attached to the distal end 36 of shaft 35 for retaining the roller on the shaft. The lock ring 37 is split at one section of its circumference (not shown) such that a load is not exerted equally along the circumference causing the lock ring to be self-tensioning.

Sif Felt® foam is a compressed, reticulated polyester foam made by compressing a 90 pores-per-linear-inch (ppl) Sif® foam with both pressure and heat. It is available from Foamex, 1500 East Second Street, Eddystone, Pa. 19022, part number 10-900Z, which supplies sheets at the height and firmness specified. A fabricator, E.N. Murray Co., Inc. of 707 Umatilla Street, Denver, Colo. 80202 then die-cuts the foam to size and height specifications. The Sif-Felt® foam reservoirs many times it weight of various types of liquids and powders and the cell structure provides excellent, controllable capillary action for transferring fluids. Other benefits include conformation to contact surface and shape retention due to a resilient nature, and low flow resistance. Sif Felt® is a registered trademark of Foamex.

FIG. 2 further illustrates the roller 25 in relation to the handle 5 and the shaft 35. The roller 25 can be comprised of any material which is capable of absorbing and retaining fluids, however, it is preferably comprised of the Sif Felt® foam. The Sif Felt® roller 25 eliminates the requirement for a liquid reservoir or a stick of paste and in turn eliminates the threat of leaking liquid polish and undesirable staining of items.

In a preferred embodiment the roller 25 has a flat top 26 and bottom 24. The roller may be of any dimensions but preferably has a top to bottom length of ⅜ of an inch and a diameter equal to that of the diameter of the handle 5.

The conformation to contact surface characteristic of the Sif Felt ® foam allows the roller 25 to conform to the heels 44 and edges 42 of the shoe soles. In this way, the roller 25 provides for cleaner and more defined application of the fluid dressing agent. The roller 25 will also reassume its original shape after the conformation to the contact surface. This conformation characteristic allows the applicator to be used with a wider variety of shoes, including but not limited to dress shoes, casual shoes, suede covered shoes and sneakers.

While the roller 25 may be able to absorb a great amount of the fluid dressing agent it will not dry into a hardened mass due to the unique qualities of the Sif Felt ® foam.

The fluid dressing agent used to saturate the Sif Felt ® of the wicking foam and the roller includes but is not limited to inks, dyes, stains, powders and clear polishes.

Figure 3:
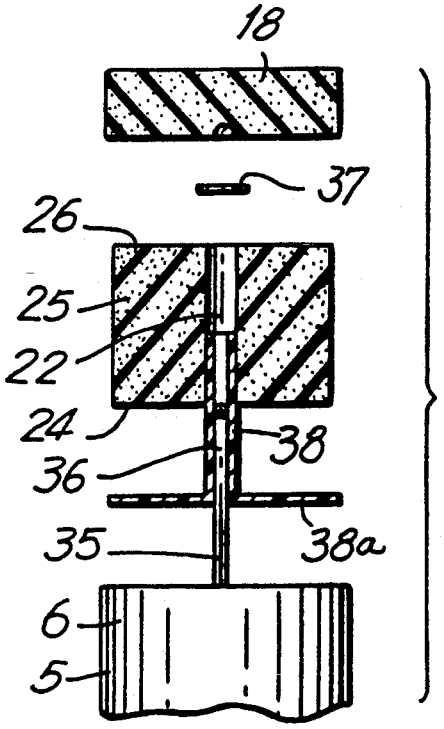
FIG. 3 is an exploded view of an embodiment of the present invention.

The roller 25 may be mounted to the handle 5 in any of a number of ways. In FIG. 3 the roller 25 is mounted to the shaft through the use of a central opening 22 extending entirely through the longitudinal axis of the roller 25. The roller is slid over and disposed around the shaft 35 in such a way that the shaft 35 is inserted in the central opening 22. The shaft 35 has a proximal end 34 and a distal end 36. The proximal end 34 of the shaft 35 is attached, by any suitable means, e.g. welding or adhesives, to the top end 6 of the handle 5 such that the shaft 35 extends up and away from the top end 6 of the handle 35 as one moves from the proximal end 34 to the distal end 36. This arrangement allows for mounting of the roller 25 to the handle 5 in the most compact way.

FIG. 3 further illustrates a bearing 38 closely received within the central opening 22 of the roller 25. The bearing 38 is then slid over the distal end 36 of the shaft 35 such that the bearing 38 is disposed between the roller 25 and the shaft 35 facilitating rotation of the roller 25 around the shaft 35. The bearing 38 reduces the friction which would otherwise be created between the shaft 35 and the roller 25 in the absence of the bearing 38.

The bearing 38 further has a flange 38*a* extending out of the bottom of the central opening 22 of the roller 25 to prevent the bottom 24 of the roller 25 from contacting the top end 6 of the handle 5 to further facilitate the rotation of the roller 25 during operation. The bearing 38 preferably has a length which is less than that of the shaft 35. The bearing and shaft are preferably comprised of plastic and the shaft is preferably hollow.

Figure 4:
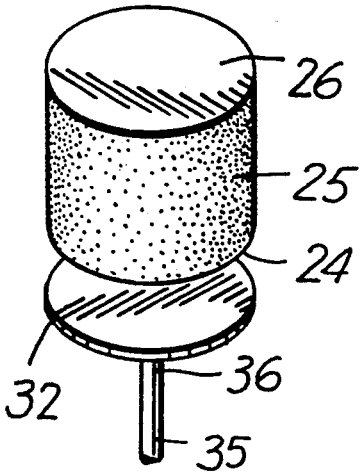
FIG. 4 is an alternative embodiment of the applicator with the roller mounted on a base.

FIG. 4 shows another preferred embodiment of the applicator of the present invention. The shaft 35 is rotatably mounted in the top end 6 of the handle 5 at its proximal end 34 and fixedly secured to a base 32 at its distal end 36. The roller 25 is secured to the base 32 at the bottom 24 such that the shaft 35 rotates during operation and in turn rotates the base 32 and the roller 25. The roller 25 may be attached to the base by any suitable means, including but not limited to adhesives.

Figure 5:
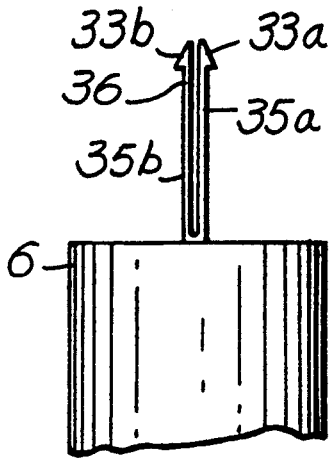
FIG. 5 is shows an alternative embodiment of the shaft.

FIG. 5 shows an alternative manner of retaining the roller 25 on the shaft 35. The shaft 35 has a pair of upwardly extending arms 35*a* and 35*b*. Each arm has a tang 33*a* and 33*b*, respectively, on the distal end 36. The tangs 33*a* and 33*b* skive inward as the roller 25 is inserted over the arms 35*a* and 35*b* and snap outward after the roller 25 is fully inserted such that the tangs exert a force on the top 26 of the roller 25 to rotatably hold it on the shaft.

Figure 6:
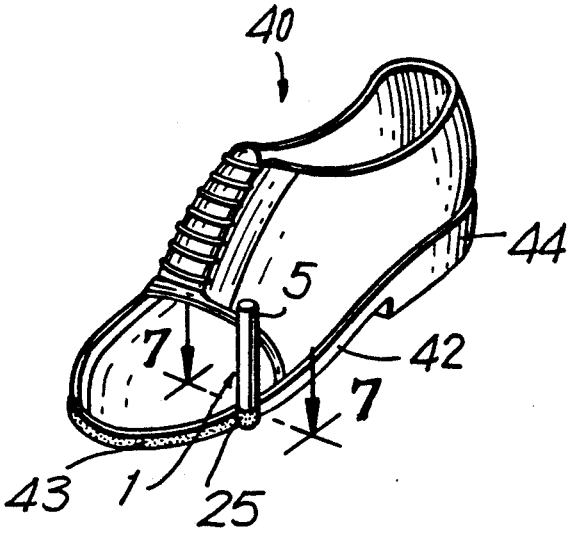
FIG. 6 shows the use of the applicator in polishing an edge of a shoe sole.
Figure 7:
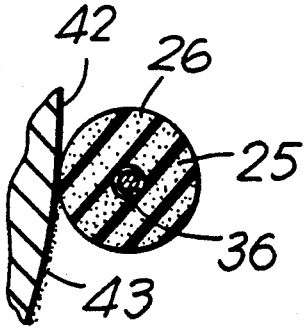
FIG. 7 is an enlarged cutaway view taken along line 7—7 of FIG. 6 showing the top of the roller and a polished area of the edge of the shoe sole.

The method for applying shoe polish ink to the heels and edges of shoe soles is generally shown in FIG. 6 and FIG. 7. When the applicator 1 according to the present invention is operated a user grips the handle 5 and contacts the roller 25 with the edge 42 or heel 44 of an ordinary shoe 40. The roller 25 is held in firm contact with the edge 42 or heel 44. The handle 5 is then moved laterally such that the roller 25 is kept in close contact with the heel 44 or edges 42 of the shoe soles to be polished.

In FIG. 6 the applicator 1 is operated to polish a shoe edge 42. The roller 25 is pressed firmly against the shoe edge 42 causing ink to discharge and coat the shoe edge to provide a polished edge 43. The arrow shows the direction of movement of the applicator 1.

In FIG. 7 the top 26 of the roller 25 is shown. The distal end 36 of shaft 35 is shown extending from the central opening 22 of the roller 25. The shoe edge 42 is shown as having a polished edge 43 in that portion where the roller 25 has been passed over and an unpolished edge 42 ahead of the roller 25. After polishing, the user places the cap 15 over the roller 25 to re-ink the roller 25.

While various changes may be made in the detailed construction, it is understood that such changes will be in the spirit and scope of the present invention as is defined by the appended claims.

What is claimed is:

1. A dispenser for a liquid material, particularly a shoe polish, comprising:

a handle formed from a stiff and substantially inflexible material;

a roller journalled on said handle for rotary movement of said roller about a longitudinal axis of said roller, said roller being formed of a liquid pervious wicking material and having axial ends;

a liquid impervious cap detachably attached to said handle in encircling relation with said roller;

a pad of a liquid pervious wicking material rigidly secured within said cap in compressive contacting relation with one said axial end of said roller, said pad providing a reservoir for said liquid material, said pad being infused with said liquid material and being operative to transfer said liquid material to said roller by capillary wicking action;

whereby, when said cap is detached from said handle, said roller is directly available for the application of said liquid material transferred to said roller from said pad to a receiver surface of an article.

* * * * *